US006984618B2

(12) United States Patent
Heinzman et al.

(10) Patent No.: US 6,984,618 B2
(45) Date of Patent: Jan. 10, 2006

(54) SOFTENING-THROUGH-THE WASH COMPOSITION

(75) Inventors: Stephen Wayne Heinzman, Cincinnati, OH (US); Nathalie Sophie Letzelter, Newcastle-Upon-Tyne (GB); Fiona Susan Williams, Newcastle-Upon-Tyne (GB); Leanne Bolton, Sunderland (GB)

(73) Assignee: The Procter & Gamble Company, Cincinnati, OH (US)

( * ) Notice: Subject to any disclaimer, the term of this patent is extended or adjusted under 35 U.S.C. 154(b) by 208 days.

(21) Appl. No.: 10/310,432

(22) Filed: Dec. 5, 2002

(65) Prior Publication Data

US 2003/0130152 A1 Jul. 10, 2003

Related U.S. Application Data

(60) Provisional application No. 60/359,155, filed on Feb. 22, 2002, provisional application No. 60/358,922, filed on Feb. 22, 2002, provisional application No. 60/337,807, filed on Dec. 5, 2001.

(51) Int. Cl.
*C11D 1/65* (2006.01)
*C11D 3/12* (2006.01)

(52) U.S. Cl. ..... 510/507; 510/516

(58) Field of Classification Search ..... 510/507, 510/516

See application file for complete search history.

(56) References Cited

U.S. PATENT DOCUMENTS 4,840,738 A 6/1989 Hardy et al.
5,700,387 A * 12/1997 Haq et al. ..... 252/8.63
5,721,202 A * 2/1998 Waite et al. ..... 510/102
5,744,435 A * 4/1998 Hartman et al. ..... 510/101
6,020,302 A * 2/2000 Leurentop et al. ..... 510/475
6,025,321 A * 2/2000 Smith et al. ..... 510/516
6,037,315 A 3/2000 Franklin et al.
6,093,336 A 7/2000 Ploumen et al.

FOREIGN PATENT DOCUMENTS

| | | |
|---|---|---|
| EP | 0 704 522 B1 | 4/1996 |
| EP | 0 720 645 B1 | 7/1996 |
| WO | WO 94/07978 | 4/1994 |

* cited by examiner

*Primary Examiner*—John R. Hardee
(74) *Attorney, Agent, or Firm*—David V. Upite; Julia A. Glazer

(57) ABSTRACT

The present invention relates to a softening-through-the-wash composition comprising:
(i) a fabric-softening cationic quaternary ammonium di-ester compound comprising a cationic quaternary ammonium component having the formula:

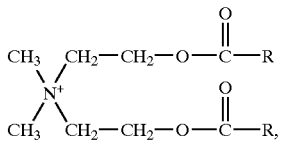

wherein, each R is independently selected from $C_{12}$–$C_{22}$ alkyl groups; and (ii) a source of acid selected from the group consisting of $C_{12}$–$C_{22}$ fatty acids, mono-alkyl esters of a $C_{12}$-$C_{22}$ alkyl sulphuric acids, $C_{11}$–$C_{13}$ alkyl benzene sulphonic acids, anionic derivatives thereof, salts thereof, and combinations thereof; and (iii) clay; and (iv) one or more adjunct components.

7 Claims, No Drawings

SOFTENING-THROUGH-THE WASH COMPOSITION

CROSS REFERENCE TO RELATED APPLICATIONS

This application claims the benefit of U.S. Provisional Application Ser. No. 60/337,807, filed Dec. 5, 2001, U.S. Provisional Application Ser. No. 60/358,922, filed Feb. 22, 2002, and U.S. Provisional Application Ser. No. 60/359,155, filed Feb. 22, 2002.

TECHNICAL FIELD

The present invention relates to a softening-through-the wash composition (STW-composition).

BACKGROUND TO THE INVENTION

STW-compositions simultaneously clean and soften fabric during the washing stage of the laundering process, negating the need to add a separate fabric-conditioning composition to the rinse stage and/or drying stage of the laundering process. Therefore, STW-compositions provide the consumer with an efficient and easy way to clean and soften fabric during the laundering process.

Fabric-softening quaternary-ammonium di-ester compounds (di-ester-quats) are a known means of softening fabric during the rinse stage and/or drying stage of the laundering process. For example, rinse added and/or drier added compositions comprising di-ester-quats are described in EP704522, EP720645, U.S. Pat. Nos. 4,840,738 and 6,037,315. In addition, U.S. Pat. No. 6,093,336 relates to a process for making a composition comprising a di-ester-quat and a fatty acid. U.S. Pat. No. 6,093,336 discloses a process, which is said to produce compositions comprising low amounts of impurities, and that are storage stable and non-caking. Also, WO94/07978 relates to compositions comprising a di-ester-quat and a hydroxy compound. The compositions described WO94/07978 are said to have improved cold water dissolution and/or dispersability.

However, prior to the present invention, detergent manufacturers were not able to incorporate fabric-softening compounds such as di-ester-quats, in STW-compositions, especially solid STW-compositions, without adversely affecting the fabric-cleaning performance. Di-ester-quats, although capable of providing extremely good fabric-softening properties during the rinsing and/or drying stage of the laundering process, cannot be successfully incorporated into detergent compositions as they cause residues to deposit on fabric during the laundering process and also reduce the soil removal performance of the STW-composition. Thus, there is still a need to produce improved STW-compositions having both a good fabric-softening performance and a good fabric-cleaning performance.

The inventors have surprisingly found that specific di-ester-quats, when used in combination with a specific source of acid and clay, can be successfully incorporated in STW-compositions. These specific di-ester-quats, when used in combination with the specific source of acid and clay, greatly improve the fabric-softening performance of the STW-composition without adversely affecting the fabric-cleaning performance. Thus, the STW-compositions of the present invention have a surprisingly improved fabric-cleaning and fabric-softening performance.

SUMMARY OF THE INVENTION

In a first embodiment of the present invention, there is provided a softening-through-the-wash composition comprising: (i) a fabric-softening quaternary ammonium di-ester compound comprising a cationic quaternary ammonium component having the formula:

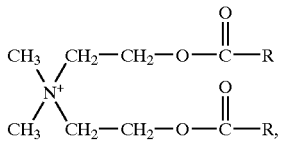

wherein, each R is independently selected from $C_{12}$–$C_{22}$ alkyl groups; and (ii) a source of acid selected from the group consisting of $C_{12}$–$C_{22}$ fatty acids, mono-alkyl esters of a $C_{12}$–$C_{22}$ alkyl sulphuric acids, $C_{11}$–$C_{13}$ alkyl benzene sulphonic acids, anionic derivatives thereof, salts thereof, and combinations thereof; and (iii) clay; and (iv) one or more adjunct components.

In a preferred embodiment of the present invention, the composition is a solid softening-through-the-wash detergent composition and the source of acid is selected from $C_{12}$–$C_{22}$ fatty acids, anionic derivatives thereof, and combinations thereof.

In a second embodiment of the present invention, there is provided a softening-through-the-wash composition comprising: (a) a particle comprising: (i) a fabric-softening quaternary ammonium di-ester compound comprising a cationic quaternary ammonium component having the formula:

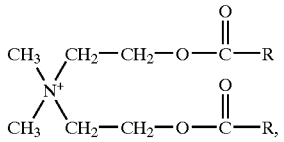

wherein, each R is independently selected from $C_{12}$–$C_{22}$ alkyl groups; and (ii) a source of acid selected from the group consisting of $C_{12}$–$C_{22}$ fatty acids, mono-alkyl esters of a $C_{12}$–$C_{22}$ alkyl sulphuric acids, $C_{11}$–$C_{13}$ alkyl benzene sulphonic acids, anionic derivatives thereof, salts thereof, and combinations thereof; and (iii) optionally clay; and (iv) optionally one or more adjunct components; and (b) one or more adjunct components.

In a third embodiment of the present invention, there is provided the use of the above compositions to reduce creasing of fabric, and/or to soften fabric, and/or to confer an ease of ironing benefit to fabric, and/or to confer an anti-static benefit to fabric, and/or to reduce the fading of colour from fabric, and/or to confer a skin moisturising benefit to fabric, and/or to removal soil from fabric, and/or to confer a stain release benefit to fabric, and/or to soften fabric-without hydrophobizing the fabric.

DETAILED DESCRIPTION OF THE INVENTION

Fabric-Softening Quaternary Ammonium Ester Compound

The STW-composition comprises a di-ester-quat. Preferably, the STW-composition comprises (by weight of the composition) from 0.1% to 30%, preferably from 0.5%, or from 1%, or from 1.5%, and preferably to 20%, or to 15%, or to 10%, or to 5%, or to 3% di-ester-quat. The STW-composition may comprise (by weight of the composition) less than 5% di-ester quat, or even less than 4%, or less than 3% di-ester quat.

Without wishing to be bound by theory, the inventors believe that the di-ester-quat deposits on the fabric surface during the washing stage of the laundering process, whereupon it lubricates the fabric fibres at or near the fabric surface, thus, softening the fabric. In addition, the inventors believe that the di-ester quat interacts with the source of acid and clay, such that the source of acid and clay are also deposited on the fabric surface, the di-ester-quat may even act as a means to enhance the deposition of the source of acid, and possibly the clay, on the fabric surface. The Inventors believe that the deposition of the source of acid and clay on the fabric surface provides some enhancement of the fabric-softening performance of the STW-composition. Furthermore, the di-ester-quat, when present in combination with the source of acid and clay, is surprisingly compatible with the adjunct component(s) of the STW-composition.

The di-ester-quat comprising a cationic quaternary ammonium component that is represented by the formula:

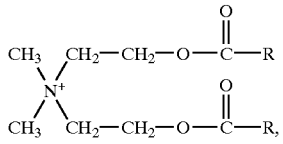

wherein, each R is independently selected from $C_{12}$–$C_{22}$ alkyl groups. Preferably, each R is independently selected from $C_{13}$, or from $C_{14}$, or from $C_{15}$, or from $C_{16}$, and preferably to $C_{20}$, or to $C_{19}$, or to $C_{18}$, or to $C_{17}$ alkyl groups. Alternatively, it may be preferred that each R is independently selected from $C_{12}$–$C_{15}$ alkyl groups. R may be a saturated alkyl group. Alternatively, R may be an unsaturated alkyl group. R may be an unsaturated alkyl group having an iodine value of from 18–25. A highly preferred di-ester-quat is dimethyl bis(steroyl oxyethyl) ammonium chloride.

The cationic quaternary ammonium component can optionally be in the form of a complex with a counter-anion. Thus, the complex can represented by the formula:

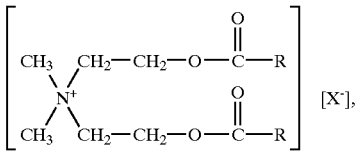

wherein, each R is independently selected from $C_{12}$–$C_{22}$ alkyl groups as defined above, and $X^-$ is a counter-anion. $X^-$ may be any conventional counter ion. $X^-$ is preferably an anion selected from the group consisting of halide, sulphate, sulphonate, nitrate, carboxylate, carbonate, phosphate, phosphonate, borate, derivatives thereof, and combinations thereof. Preferred halides and derivatives thereof are selected from the group consisting of chloride, bromide, iodide, fluoride, and combinations thereof. Preferred carboxylates and derivatives thereof are selected from the group consisting of methanoate, ethanoate, propanoate, 2-hydroxypropane-1,2,3-tricarboxylate (citrate), butanedicarboxylate (adipate), benzoate, and combinations thereof. A preferred sulphate and derivative thereof is methyl sulphate. A preferred phosphate and derivative thereof is hexafluorophosphate. A preferred phosphonate and derivative thereof is di-methyl phosphonate. Preferably, $X^-$ is an anion selected from the group consisting of chloride, bromide, methanoate, ethanoate, sulphate, sulphonate, phosphate, phosphonate, and combinations thereof. Most preferably, $X^-$ is an anion selected from the group consisting of chloride, bromide, and combinations thereof.

The di-ester-quat may be obtained by any conventional process. A preferred process for obtaining a di-ester-quat, comprises the steps of: (i) reacting a di-alcohol secondary and/or tertiary amine with a source of acid, wherein the source of acid is a $C_{12}$–$C_{22}$ fatty acid or an anionic derivative thereof, to form a di-ester secondary and/or tertiary amine; and (ii) quaternising the di-ester secondary and/or tertiary amine to form a di-ester-quat. Preferably, a catalyst is present during step (i) above. Preferably, an excess of source of acid is present in step (i). Preferably a quaternising agent is present in step (ii) above. A preferred quaternising agent is selected from methyl chloride, methyl sulphate, methyl bromide, methyl iodide and combinations thereof. A preferred quaternising agent is methyl chloride and/or methyl sulphate. Preferably the quaternising agent is in the form of a gas. If the quaternising agent is methyl chloride, then it may be preferred that an excess of quaternising agent is present in step (ii). Optionally, an antioxidant is used in step (i) and/or step (ii). Typically, step (i) and/or step (ii) are carried out at a high temperature. Typically, a high temperature is a temperature above 95° C.

Optionally, a solvent is present in step (i) and/or step (ii). Preferred solvents are selected from $C_{1-5}$ alcohols and isomers thereof. A preferred solvent is ethanol and/or isopropanol. Preferably, the molar ratio of the di-alcohol secondary and/or tertiary amine to source of acid is at least 2:1, more preferably at least 3:1.

Source of Acid

The STW-composition comprises a source of acid. Preferably, the STW-composition comprises (by weight of the composition) from 0.1% to 30%, preferably from 0.5%, and preferably to 20%, or to 10%, or to 5% source of acid. Without wishing to be bound by theory, the inventors believe that the source of acid, when in combination with the di-ester-quat and clay, protects the di-ester-quat from interactions with the adjunct component(s) of the STW-composition. In addition, the inventors believe that the source of acid, especially when the source of acid is a $C_{12}$–$C_{22}$ fatty acid or even an anionic derivative of a $C_{12}$–$C_{22}$ fatty acid, deposits on the surface of the fabric, whereupon it lubricates the fabric fibres at or near the fabric surface, thus, softening the fabric.

The source of acid is selected from the group consisting of: $C_{12}$–$C_{22}$ fatty acids, mono-alkyl esters of a $C_{12}$–$C_{22}$ alkyl sulphuric acids, $C_{11}$–$C_{13}$ alkyl benzene sulphonic acids, anionic derivatives thereof, salts thereof, and combinations thereof. The term "anionic derivative" is typically intended to include dissociated acids.

Preferably, the source of acid is selected from the group consisting of $C_{12}$–$C_{22}$ fatty acids, anionic derivatives thereof, salts thereof, and combinations thereof. More preferably, the source of acid is selected from $C_{12}$–$C_{22}$ fatty acids, anionic derivatives thereof, and combinations thereof. Most preferably, the source of acid is selected from $C_{12}$–$C_{22}$ fatty acids.

$C_{12}$–$C_{22}$ fatty acids can be represented by the formula:

$$R_1—COOH,$$

wherein, $R_1$ is a $C_{11}$–$C_{21}$ alkyl group. Salts of fatty acids can be represented by the formula:

$$R_1—COO^-M^+,$$

wherein, M+ is an alkali metal ion, preferably $Na^+$ and/or $K^+$, and $R_1$ is a $C_{11}$–$C_{12}$, alkyl group. Anionic derivatives of fatty acids can be represented by the formula $$R_1—COO^-,$$

wherein, $R_1$ is a $C_{11}$–$C_{12}$, alkyl group.

Preferred sources of $C_{12}$–$C_{22}$ fatty acids are selected from the group consisting of: lauric acid, tridecylic acid, myristic acid, pentadecylic acid, palmitic acid, margaric acid, stearic acid, arachidic acid, phytanic acid, behenic acid, anionic derivatives thereof, salts thereof, and combinations thereof. Most preferably, the source of acid is stearic acid.

Preferred sources of acid are $C_{12}$–$C_{22}$ fatty acids comprising a saturated alkyl group. Other preferred sources of acids are $C_{12}$–$C_{22}$ fatty acids comprising an unsaturated group, typically having an iodine value of from 15 to 25, preferably from 18 to 22.

The source of acid may be selected from the group consisting of palmitoleic acid, oleic acid, elaidic acid, vaccenic acid, linoleic acid, cis-eleostearic acid, trans-eleostearic acid, linolenic acid, arachidonic acid, anionic derivatives thereof, salts thereof, and combinations thereof.

Preferred sources of fatty acids are selected from the group consisting of coconut, soybean, tallow, palm, palm kernel, rapeseed, lard, sunflower, corn, safflower, canola, olive, peanut, and combinations thereof. A highly preferred source of fatty acid is tallow. Preferred fatty acids have a cis:trans isomer ratio of from 1:1 to 200:1, preferably from 10:1 to 200:1. A preferred source of acid is hard tallow fatty acid and/or partially hydrogenated tallow fatty acid.

The source of acid may be a $C_{11}$–$C_{13}$ alkyl benzene sulphonic acid. The source of acid may be an anionic derivative or a salt of a $C_{11}$–$C_{13}$ alkyl benzene sulphonic acid.

The source of acid may be a mono-alkyl ester of a $C_{12}$–$C_{22}$ alkyl sulphuric acid. The acid source may be an anionic derivative or a salt of a mono-alkyl ester of a $C_{12}$–$C_{22}$ alkyl sulphuric acid. A preferred source of a mono-alkyl ester of a $C_{12}$–$C_{22}$ alkyl sulphuric acid is tallow alkyl sulphate.

Cationic-Anionic Ion Pair Complex

If the source of acid is an anionic derivative of an acid selected from the group consisting $C_{12}$–$C_{22}$ fatty acid, mono-alkyl ester of a $C_{12}$–$C_{22}$ alkyl sulphuric acid, $C_{11}$–$C_{13}$ alkyl benzene sulphonic acid, and combinations thereof, then it may be preferred that the cationic quaternary ammonium component and source of acid are in the form of a cationic-anionic ion-pair complex. The cationic-anionic ion pair complex can be represented by the formula:

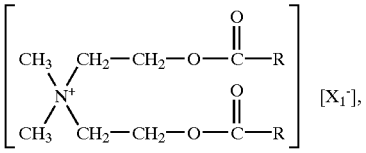

wherein, each R is independently selected from $C_{12}$–$C_{22}$ alkyl groups, and $X_1^-$ is an anionic derivative of an acid selected from the group consisting $C_{12}$–$C_{22}$ fatty acids, mono-alkyl esters of a $C_{12}$–$C_{22}$ alkyl sulphuric acids, $C_{11}$–$C_{13}$ alkyl benzene sulphonic acids, and combinations thereof.

Preferably, $X_1^-$ is represented by the formula:

$$R_1—COO— \text{ or } R_1—OSO_3^-,$$

wherein, $R_1$ is a $C_{11}$–$C_{21}$ alkyl group. Most preferably, $X_1^-$ is represented by the formula:

$$R_1—COO^-,$$

wherein, $R_1$ is a $C_{11}$–$C_{21}$ alkyl group.

The cationic-anionic complex can be obtained by any conventional process. A typical process involves the following four steps. 1. Esterification of an appropriate aminoalcohol with fatty acid to give an esteramine. 2. Quaternization of the esteramine with a suitable quaternizing agent in an alcoholic solvent. 3. Treatment of the alcoholic quaternary solution with a fatty acid salt. 4. Removal of the resultant insoluble inorganic salt.

Typically, the cationic-anionic complex is obtainable, preferably obtained, by a process comprising the step of esterifying a quaternary ammonium compound having a structure represented by the formula:

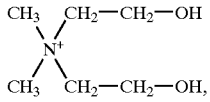

in the presence of an oxo acid of phosphorous and/or an alkali metal salt thereof and/or an alkaline earth metal salt thereof, in the presence of a $C_{11}$–$C_{21}$ fatty acid, while removing at least part of the water that is produced by the esterification reaction from the resulting mixture of esterification reaction products.

Typically, the molar ratio of $C_{11}$–$C_{21}$ fatty acid to quaternary ammonium compound is at least 1.5:1, and is preferably from 4:1 to 20:1, most preferably at least 15:1, and typically less than 100:1. Preferably, the reaction is carried out at a temperature of at least 100° C., more preferably from 130° C. to 220° C., or from 150° C. to 170° C.

Preferably, at least 50% of the water, or even substantially all of the water present after the esterification reaction, is removed from the resulting mixture of esterification reaction products. The withdrawal of water from the resulting mixture of esterification reaction products is typically achieved by using a vacuum and/or an appropriate water trap, and results in an increase in the conversion efficiency of the esterification reaction. Preferably, the process is performed in a vacuum, such as at a pressure of $2\times10^4 Nm^{-2}$ or less.

Typically, the esterification reaction is carried out in a container having a means for separating water, preferably having a water trap.

Preferred oxo acids of phosphorous are selected from group consisting of di-phosphoric acid, metaphosphoric acid, polyphosphoric acid, phosphorous acid, phosphoric acid, hypophosphorous acid, and combinations thereof. Preferred salts of oxo acids of phosphorous are selected from the group consisting of: mono-sodium di-hydrogen hypophosphite, sodium hypophosphite monohydrate, and combinations thereof. The oxo acid of phosphorous and/or salt thereof may be in the form of a solution, preferably an aqueous solution. The cationic-anionic complex can be obtained by the process described in U.S. Pat. Nos. 6,093,336 and 6,166,232.

The cationic-anionic complex may also be obtainable, preferably obtained, by a process comprises the steps of: (i) obtaining a mixture comprising a solvent, a di-ester-quat and a source of acid, wherein the di-ester-quat is in the form of a complex with a counter-anion, and wherein the source of acid is a salt of one or more acids selected from the group consisting of: $C_{12}$–$C_{22}$ fatty acid, mono-alkyl ester of a $C_{12}$–$C_{22}$ alkyl sulphuric acid, $C_{11}$–$C_{13}$ alkyl benzene sulphonic acid, and combinations thereof; and (ii) desalting the mixture to form a cationic-anionic complex.

Preferred solvents are $C_{1-5}$ alcohols and isomers. Other preferred solvents are heptane and/or hexane. A highly preferred solvent selected from methanol, ethanol, isopropanol, and combinations thereof. Preferred processes for obtaining a mixture comprising a di-ester-quat and a source of acid that can be used to obtain the mixture in step (i), are described in more detail below. A preferred desalting means is selected from filtration, decanting, sedimentation, extraction, centrifugation, and combinations thereof.

Clay

The STW-composition comprises clay. Preferably, the STW-composition comprises (by weight of the composition) from 0.1% to 30%, preferably from 1%, or from 5%, and preferably to 20%, or to 15%, or to 10%, or to 7% clay. The STW-composition may comprise (by weight of the composition) less than 7% clay. The STW-composition may comprise (by weight of the composition) 5% clay, or even greater than 5% clay. If the STW-composition is a solid STW-composition, then preferably the STW-composition composition comprises a detergent particle that comprises clay and an adjunct component selected from the group consisting of wax, glycerol, flocculant, and combinations thereof. In another preferred embodiment of the present invention, the STW-composition comprises a detergent particle comprising clay or part thereof, the di-ester quat or part thereof, and the source of acid or part thereof, and optionally other adjunct component(s) preferably selected from the group consisting of flocculant, wax, glycerol, and combinations thereof.

Preferably, the weight ratio of clay to di-ester quat is from 0.5:1 to 20:1, preferably from 1:1 to 20:1, or from 1:1 to 10:1, or preferably greater than 1:1, or even greater than 2:1. Preferably, the weight ratio of clay to the source of acid is from 1:1 to 50:1, preferably from 5:1 to 50:1, or preferably greater than 5:1. Preferably, the weight ratio of clay to the combined weight of the di-ester quat and source of acid is from 0.1:1 to 10:1, preferably from 1:1 to 5:1, or preferably greater than 1:1.

If the particulate solid STW-composition comprises a flocculant, then preferably the weight ratio of clay to flocculant is from 5:1 to 100:1. In addition, preferably the flocculant, or part thereof, and the clay, or part thereof, are comprised by the same particle. Optionally, the particle comprises additional adjunct components, preferably glycerol and wax.

Typically, the clay is selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydoxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

Preferably, the clay is a smectite clay. Preferred smectite clays are beidellite clays, hectorite clays, laponite clays, montmorillonite clays, nontonite clays, saponite clays and mixtures thereof. Preferably, the smectite clay may be a dioctahedral smectite clay. A preferred dioctahedral smectite clay is montmorillonite clay. The montmorillonite clay may be low-charge montmorillonite clay (also known as sodium montmorillonite clay or Wyoming-type montmorillonite clay). Typically, low-charge montmorillonite clay can be represented by the formula:

$$Na_xAl_{2-x}Mg_xSi_4O_{10}(OH)_2,$$

wherein, x is a number from 0.1 to 0.5, preferably from 0.2, and preferably to 0.4. The montmorillonite clay may also be a high-charge montmorillonite clay (also known as a calcium montmorillonite clay or Cheto-type montmorillonite clay). Typically, high-charge montmorillonite clays can be represented by the formula:

$$Ca_xAl_{2-x}Mg_xSi_4O_{10}(OH)_2,$$

wherein, x is a number from 0.1 to 0.5, preferably from 0.2, and preferably to 0.4.

Preferably, the smectite clay is a trioctahedral smectite clay. A preferred trioctahedral smectite clay is hectorite clay. Typically, hectorite clay can be represented by the following formula:

$$[(Mg_{3-x}Li_x)Si_{4-y}Me^{III}{}_yO_{10}(OH_{2-z}F_z)]^{-(x+y)}((\quad x+y)/n)\ M^{n+},$$

wherein: y=0 to 0.4, if y=>0 then $Me^{III}$ is AL, Fe or B, preferably y=0; and n is 1 or 2; and $M^{n+}$ is a monovalent (n=1) or a divalent (n=2) metal ion, preferably $M^{n+}$ is selected from the group Na, K, Mg, Ca and Sr; and x is a number from 0.1 to 0.5, preferably from 0.2, or from 0.25, and preferably to 0.4, or to 0.35; and z is a number form 0 to 2; and the value of x+y is the layer charge of the hectorite clay, preferably the value of x+y is from 0.1 to 0.5, preferably from 0.2, or from 0.25, and preferably to 0.4 or to 0.35.

Preferred hectorite clays have a cationic exchange capacity of at least 90 meq/100 g. Typically, the cationic capacity of clays are measured by the method described in Grimshaw, The Chemistry and Physics of Clays, 1971, Interscience Publishers Inc., pages 264–265. Especially preferred Hectorite clays are supplied by Rheox, and sold under the tradenames "Hectorite U" and "Hectorite R".

The clay may be a light coloured crystalline clay mineral, preferably having a reflectance of at least 60, more preferably at least 70, or at least 80 at a wavelength of 460 nm.

Typically, the average particle size of the light coloured crystalline clay mineral particles should not exceed 2 μm, especially preferably not exceeding 1 μm. The average particle size of the light coloured crystalline clay mineral particles is typically measured using a Malvern Zetasizer™, using a dispersion of the light coloured crystalline clay at 0.1 g/l in deionised water, the clay being dispersed by vigorous agitation for 1 minute. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

The clay, in combination with the di-ester-quat and source of fatty acids, gives a surprising fabric-softening performance, ease of ironing benefit, reduces creasing of fabric, confers an ease of ironing benefit to fabric, confers an anti-static benefit to fabric, reduces the fading of colour from fabric, confers a skin moisturising benefit to fabric and improves the soil removal performance of the STW-composition.

Adjunct Components

The STW-composition comprises one or more adjunct components. Typically, the detergent composition comprises from 10% to 99.7%, preferably from 25%, or from 50%, or from 75%, and preferably to 95% adjunct components. Preferred adjunct components are selected from the group consisting of: anti-redeposition agents, bleaching agents, brighteners, builders, chelants, dye-transfer inhibitors, enzymes, fabric-integrity agents, fillers, flocculants, perfumes, soil release agents, surfactants, soil-suspension agents, and combinations thereof.

A highly preferred adjunct component is a surfactant. Preferably, the STW-composition comprises one or more surfactants. Typically, the STW-composition comprises (by weight of the composition) from 0% to 50%, preferably from 5% and preferably to 40%, or to 30%, or to 20% one or more surfactants. Preferred surfactants are anionic surfactants, non-ionic surfactants, cationic surfactants, zwitterionic surfactants, amphoteric surfactants, catanionic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. The $C_{8-18}$ alkyl sulphates and/or $C_{8-18}$ alkyl sulphonates may optionally be condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups. Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_8$–$C_{18}$ alkyl benzene sulphonate, and combinations thereof. Preferred alkali metals are sodium, potassium and mixtures thereof. Typically, the STW-composition comprises from 0% to 50% anionic surfactant.

Preferred non-ionic surfactants are selected from the group consisting of: $C_{8-18}$ alcohols condensed with from 1 to 9 of $C_1$–$C_4$ alkylene oxide per mole of $C_{8-18}$ alcohol, $C_{8-18}$ alkyl N—$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the STW-composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides.

Typically, catanionic surfactants are complexes comprising a cationic surfactant and an anionic surfactant. Typically, the molar ratio of the cationic surfactant to anionic surfactant in the complex is greater than 1:1, so that the complex has a net positive charge.

A preferred adjunct component is a builder. Preferably, the STW-composition comprises (by weight of the composition and on an anhydrous basis) from 5% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; layered silicates, salts thereof, and combinations thereof, preferably sodium layered silicate; and combinations thereof.

A preferred adjunct component is a bleaching agent. Preferably, the STW-composition comprises one or more bleaching agents. Typically, the STW-composition comprises (by weight of the composition) from 1% to 50% of one or more bleaching agent. Preferred bleaching agents are selected from the group consisting of sources of peroxide, sources of peracid, bleach boosters, bleach catalysts, photobleaches, and combinations thereof. Preferred sources of peroxide are selected from the group consisting of: perborate monohydrate, perborate tetra-hydrate, percarbonate, salts thereof, and combinations thereof. Preferred sources of peracid are selected from the group consisting of: bleach activators, preformed peracids, and combinations thereof.

Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED). Preferred oxy-benzene-sulphonate bleach activators are selected from the group consisting of: nonanoyl-oxy-benzene-sulponate, 6-nona-mido-caproyl-oxy-benzene-sulphonate, salts thereof, and combinations thereof. Preferred lactam bleach activators are acyl-caprolactams and/or acyl-valerolactams. A preferred imide bleach activator is N-nonanoyl-N-methyl-acetamide. Preferred preformed peracids are selected from the group consisting of N,N-pthaloyl-amino-peroxycaproic acid, nonyl-amido-peroxyadipic acid, salts thereof, and combinations thereof. Preferably, the STW-composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in U.S. Pat. Nos. 5,360,568, 5,360,569 and 5,370,826.

A preferred adjunct component is an anti-redeposition agent. Preferably, the STW-composition comprises one or more anti-redeposition agents. Preferred anti-redeposition agents are cellulosic polymeric components, most preferably carboxymethyl celluloses.

A preferred adjunct component is a chelant. Preferably, the STW-composition comprises one or more chelants. Preferably, the STW-composition comprises (by weight of the composition) from 0.01% to 10% chelant. Preferred chelants are selected from the group consisting of: hydroxy-ethane-dimethylene-phosphonic acid, ethylene diamine tetra (methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the STW-composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

A preferred adjunct component is an enzyme. Preferably, the STW-composition comprises one or more enzymes. Preferred enzymes are selected from then group consisting of: amylases, arabinosidases, carbohydrases, cellulases, chondroitinases, cutinases, dextranases, esterases, 62-glucanases, gluco-amylases, hyaluronidases, keratanases, laccases, ligninases, lipases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred enzymes are selected from the group consisting of: amylases, carbohydrases, cellulases, lipases, proteases, and combinations thereof.

A preferred adjunct component is a fabric integrity agent. Preferably, the STW-composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO99/14245. Other preferred fabric integrity agents are polymeric components and/or oligomeric components that are obtainable, preferably obtained, by a process comprising the step of condensing imidazole and epichlorhydrin.

A highly preferred adjunct component is a flocculant. Preferably, the STW-composition comprises (by weight of the composition) from 0.01% to 25%, preferably from 0.5%, and preferably to 20%, or to 15%, or to 10%, or to 5% one or more flocculants. Preferred flocculants are polymeric components, typically having a weight average molecular weight of at least 100 kDa, preferably at least 200 kDa. Preferred flocculants are polymeric components derived from monomeric units selected from the group consisting of: ethylene oxide, acrylamide, acrylic acid, dimethylamino ethyl methacrylate, vinyl alcohol, vinyl pyrrolidone, ethylene imine, and combinations thereof. Other preferred flocculants are gums, especially guar gums. A highly preferred flocculant is polyethylene oxide, preferably having a weight average molecular weight of at least 100 kDa, preferably at least 200 kDa. Preferred flocculants are described in WO95/27036.

A preferred adjunct component is a salt. Preferably, the STW-composition comprises one or more salts. The salts can act as alkalinity agents, buffers, builders, co-builders, encrustation inhibitors, fillers, pH regulators, stability agents, and combinations thereof. Typically, the STW-composition comprises (by weight of the composition) from 5% to 60% salt. Preferred salts are alkali metal salts of aluminate, carbonate, chloride, bicarbonate, nitrate, phosphate, silicate, sulphate, and combinations thereof. Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the STW-composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethyl-terephthalate, 1,2-propyl glycol and methyl capped polyethyleneglycol. Other preferred soil release agents are anionically end capped polyesters.

A preferred adjunct component is a soil suspension agent. Preferably, the STW-composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula:

$$\text{bis}((C_2H_5O)(C_2H_4O)_n(CH_3)\text{—}N^+\text{—}C_xH_{2x}N^+\text{—}(CH_3)\text{-bis}((C_2H_4O)_n(C_2H_5O)),$$

wherein, n=from 10 to 50 and x=from 1 to 20. Optionally, the soil suspension agents represented by the above formula can be sulphated and/or sulphonated.

Softening-Through-the-Wash Detergent Composition

The STW-composition is typically a fully formulated laundry detergent composition or may be an additive for use in the washing stage of a laundering process. Preferably, however, the STW-composition is a fully formulated detergent composition. The STW-compostion is typically a softening-through-the-wash laundry detergent composition. The STW-composition comprises a di-ester-quat, a source of acid, clay and one or more adjunct components.

The STW composition can be used to reduce creasing of fabric, and/or to soften fabric, and/or to confer an ease of ironing benefit to fabric, and/or to confer an anti-static benefit to fabric, and/or to reduce the fading of colour from fabric, and/or to confer a skin moisturising benefit to fabric, and/or to removal soil from fabric, and/or to confer a stain release benefit to fabric, and/or to soften fabric without hydrophobising the fabric. After laundering with the STW composition, the fabric surfaces retain their hydrophilicity. This is a highly noticeable consumer benefit as many softeners generate a hydrophobic fabric surface so that for example, towel drying is less effective.

In addition it is believed, without wishing to be bound by theory, that the fabric-softening cationic quaternary ammonium di-ester compound and possibly the source of acid and also possibly the clay are deposited onto the fabric surface during the laundering process and form a layer on the fabric surface. If the fabric becomes stained after the laundering process, it is believed, that the stains, or at least part of or some of the stains, contact this fabric-softening cationic quaternary ammonium di-ester compound layer present on the fabric surface. Also, in a subsequent laundering process, this layer, or part thereof, is stripped from the fabric and a new layer is deposited on the fabric surface. During this stripping step, any stain in contact with the fabric-softening cationic quaternary ammonium di-ester compound layer is more easily removed from the fabric compared to stains directly contacted to the fabric. It is also believed, without wishing to be bound by theory, that clay improves the stripping of the fabric-softening cationic quaternary ammonium di-ester compound layer, and that when present, the clay further improves the stain removal benefit of the STW composition.

The STW-composition may be in the form of a solid composition. Solid compositions include powders, granules, noodles, flakes, bars, tablets, and combinations thereof. The STW-composition may be in the form of a liquid composition. The STW-composition may also be in the form of a paste, gel, suspension, or any combination thereof. The STW-composition may be at least partially enclosed, preferably completely enclosed, by a film or laminate such as a water-soluble and/or water-dispersible material. Preferred water-soluble and/or water-dispersible materials are polyvinyl alcohols and/or carboxymethyl celluloses. Preferably, the STW-composition is in the form of a solid composition, most preferably a particulate solid composition. Typically, the STW-composition has a bulk density of from 300 g/l to 1500 g/l, preferably from 600 g/l to 900 g/l. Preferably, the STW-composition has a size average particle size of from 200 $\mu$m to 2000 $\mu$m, preferably from 350 $\mu$m to 600 $\mu$m.

Typically, the STW-composition is obtainable, preferably obtained, by a process comprising a step selected from the group consisting of spray-drying, agglomeration, extrusion, spheronisation, and combinations thereof. Typically, the STW-composition comprises spray-dried particles, agglomerates, extrudates, and combinations thereof. The STW-composition may comprise particles that have been spheronised, for example marumerised particles.

Preferably the STW-composition comprises a particle that comprises a di-ester quat, a source of acid, optionally clay and optionally other adjunct components, preferably less than 90%, or less than 50%, or less than 10%, or even less than 5%, or even less than 1% adjunct components. Preferably, the size average particle size of the STW-composition is 200 $\mu$m or larger, preferably 350 $\mu$m or larger, and, wherein further, the size average particle size of the particle comprising the di-ester-quat and the source of acid is 120 $\mu$m or smaller, preferably 75 $\mu$m or smaller.

Preferably, the particle comprising the di-ester-quat and source of acid is a spray-dried particle, an agglomerate, or an extrudate. Preferably the particle is a spray-dried particle. If the particle is a spray-dried particle, then preferable the particle comprises less than 5%, preferably less than 1% clay. Most preferably, the spray-dried particle is substantially free of clay. Preferably, no clay is added to the spray-dried particle. The spray-dried particle preferably has a size average particle size of 200 $\mu$m or less, preferably 100 $\mu$m or less, or even 75 $\mu$m or less, and preferably from 25 $\mu$m to 150 $\mu$m. The spray-dried particle, which comprises a di-ester quat and a source of acid, may be agglomerated with clay, and optionally other adjunct components, preferably one or more flocculants, to form a particle comprising a di-ester quat, a source of acid, clay and optionally one or more adjunct components, preferably one or more flocculants.

The di-ester-quat and source of acid may be incorporated in the STW-composition separately. However, preferably, the di-ester-quat and source of acid are contacted together to form a mixture, prior to the di-ester quat and/or the source of acid contacting the clay and/or adjunct component(s).

The mixture comprising the di-ester-quat and source of acid can be obtained by any conventional process. Typically, the mixture comprising the di-ester-quat and source of acid is obtainable, preferably obtained, by a process comprising the steps of: (i) obtaining a di-ester quat by quaternising a secondary and/or tertiary di-ester amine in a substantially water-free solvent, to obtain a first mixture comprising a di-ester-quat and a substantially water-free solvent, and (ii) contacting a source of acid to the first mixture to obtain a second mixture comprising a di-ester-quat, a substantially water-free solvent, and a source of acid, and (iii) removing at least part, preferably all of the substantially water-free solvent from the second mixture to obtain a mixture comprising a di-ester-quat and a source of acid. Preferably, the mixture is solidified to form a solid mixture comprising a di-ester-quat and a source of acid.

The substantially water-free solvent is preferably a polar solvent, more preferably a $C_{1-5}$ alcohol, or an isomer thereof, or any combination thereof. Preferred substantially water-free solvents are selected from the group consisting of: ethanol, isopropanol, methanol, and combinations thereof. Typically, the term "substantially water-free" means that the solvent comprises less than 5 wt % water, preferably it means that the substantially water-free solvent comprises no free water. The substantially water-free solvent is removed from the second mixture by a means selected from the group consisting of: distillation, sparging, vacuum stripping, evaporation, and combinations thereof.

Typically, a quaternising agent is used in step (i) of the above process. A preferred quaternising agent is methyl chloride or methyl sulphate. Most preferably, an excess of quaternising agent is used in step (i) of the above process.

A mixture of a di-ester-quat and a source of acid may also be obtainable, preferably obtained, by a process comprising the steps of: (i) reacting a di-alcohol secondary and/or tertiary amine with a source of acid optionally in the presence of a solvent, wherein the source of acid is a $C_{12-22}$ fatty acid and/or an anionic derivative thereof, to obtain a first mixture comprising a di-ester secondary and/or tertiary amine, a source of acid and optionally a solvent; and (ii) optionally, removing at least part, preferably substantially all of the solvent from the first mixture, and, optionally, adding an additional source of acid to the first mixture, to obtain a mixture comprising a di-ester secondary and/or tertiary amine and a source of acid, and (iii) quaternising the di-ester secondary and/or tertiary amine to form a mixture comprising a di-ester-quat, a source of acid and optionally a solvent; and (iv) optionally, removing at least part, preferably substantially all, of the solvent to obtain a mixture comprising a di-ester-quat and a source of acid.

Preferably, the mixture is solidified to form a solid mixture comprising a di-ester-quat and a source of acid. Preferably, in step (i) the molar ratio of the source of acid to the di-alcohol secondary and/or tertiary amine is at least 2:1, preferably at least 3:1. Optionally, an additional source of acid can be added during step (ii). This additional source of acid may be a different type of source of acid than the source of acid that is present during step (i). Optionally, clay is added to the mixture, the clay can be added between steps (iii) and (iv).

It may be preferred to remove at least part, preferably all, of the solvent from the reaction mixture during step (ii). However, if the solvent is substantially all removed during step (ii), then preferably an additional source of acid is added to the reaction mixture during step (ii).

Preferably, step (i) is carried out in the presence of an oxo acid of phosphorous and/or an alkali metal salt thereof and/or an alkaline earth metal salt thereof. Preferred oxo acids of phosphorous are selected from group consisting of di-phosphoric acid, metaphosphoric acid, polyphosphoric acid, phosphorous acid, phosphoric acid, hypophosphorous acid, and combinations thereof. Preferred salts of oxo acids of phosphorous are selected from the group consisting of: mono-sodium di-hydrogen hypophosphite, sodium hypophosphite monohydrate, and combinations thereof.

Preferred solvents are selected from $C_{1-5}$ alcohols and isomers thereof. A preferred solvent is ethanol and/or isopropanol.

Preferably, the level of free amine impurity in the mixture comprising the di-ester-quat and source of acid is 5% by weight of the mixture or less, preferably 3% by weight of the mixture or less.

The mixture comprising the di-ester-quat and source of acid may be atomised and sprayed into a bed of finely ground clay and optionally other adjunct component(s), to obtain particles comprising a di-ester-quat and source of acid, which are at least partially enclosed, preferably completely enclosed, by a coating, wherein the coating comprises clay. Alternatively, the mixture comprising the di-ester-quat and source of acid may be atomised and sprayed into a bed of finely ground clay and optionally other adjunct component(s), to obtain particles comprising clay and optionally other adjunct component(s), which are at least partially enclosed, preferably completely enclosed, by a coating, wherein the coating comprises a di-ester quat and source of acid.

Optionally, clay and optionally adjunct component(s) can be dispersed in the mixture comprising the di-ester-quat and source of acid, to obtain a particle comprising a di-ester-quat, source of acid, clay and optionally adjunct component(s). Preferably, clay in the form of ground fines is dispersed in the mixture. Preferably the clay and optionally adjunct component(s) are dispersed in a molten mixture comprising the di-ester-quat and source of acid, and preferably the molten mixture is subsequently cooled, to obtain a particle comprising a di-ester-quat, source of acid, clay and optionally adjunct component(s).

Optionally, the STW-composition is obtainable, preferably obtained by a process comprising the step of adding the di-ester quat or part thereof, the source of acid or part thereof, optionally the clay or part thereof, and optionally one or more adjunct components, optionally one or more surfactant, and/or optionally one or more flocculants, to a crutcher and spray-drying the above components to obtain a spray-dried particle. The spray-dried particle comprising the di-ester-quat and source of acid may be at least partially enclosed, preferably completely enclosed by a coating. Preferably, the coating comprises clay.

Optionally, the STW-composition is obtainable, preferably obtained, by a process comprising the step of agglomerating a di-ester quat, a source of acid, optionally clay, and optionally one or more adjunct component, preferably one or more flocculants, to obtain an agglomerate. Optionally, the STW-composition is obtained by a process comprising the steps of: (i) obtaining a first mixture comprising a di-ester-quat and a source of acid; and (ii) contacting the first mixture to clay to form a second mixture; and (iii) mixing the second mixture in a high shear mixer to form a third mixture; and (iv) contacting one or more adjunct components to either the first mixture and/or second mixture and/or the third mixture to form a STW-composition.

EXAMPLES

Example 1

Diester of N-methyl Diethanolamine (DEEMA)

Fatty acid (1580 g, 5.770 moles) was placed in a glass flask and degassed with nitrogen at 58°. N-methyldiethanolamine (366.7 g, 3.077 moles) and a 50% solution of hypophosphorous acid (0.83 g) were added to the flask. The contents of the flask were heated to approximately 195° C., following which the flask was placed under reduced pressure (28–29" Hg) and held under these conditions for four hours. During the four hours some water vaporized which was collected and removed from the reaction flask. The material was then cooled and used for subsequent reactions.

Example 2

Quaternization of DEEMA with Methyl Chloride (DEQ)

DEEMA (800.0 g, 1.299 moles) and enough ethanol to make an 85% solution were placed in an autoclave. The contents of the reactor were heated to 95° C. and methyl chloride (85.3 g, 1.689 moles) was added. The reaction was allowed to proceed for seven hours before the excess methyl chloride was vented and the contents of the reactor sparged with nitrogen.

Example 3

Ion Pair of DEQ

The reaction product from the above reaction (328.5 g, 0.436 mole) was placed in a reaction flask along with an additional 500 g of ethanol. The solution was stirred at 60° C. under N2 and tallow alcohol sulfate1 (160.4 g 0.436 mole) was added. A precipitate formed. Ethanol was distilled (309 g of at 58°/17" vacuum) and replaced with 600 mL of a 50/50 heptane/hexane mixture. Perlite filter aid (5.0 g) was added and the reaction mixture filtered at 50° C. to give a solution of the ion pair, which solidified on standing. The hydrocarbon solvent was removed under reduced pressure to give the ion pair.

1. Sulfopon(r) 1218G granules from Cognis were used.

Example 4

Complex of DEQ and Fatty Acid

DEEMA as described above (406.0 g, 0.671 mole) and hydrogenated tallow fatty acid (180.9 g, 0.671 mole) were charged to an autoclave and the contents heated to 95° C. Methyl chloride (48.0 g, 0.95 mole) was added over time and the contents of the reaction digested for approximately seven hours. The excess methyl chloride was vented and the contents of the reaction mass sparged with nitrogen for 30 minutes. The material was discharged following which it solidified on standing.

Example 5

Softening-Through-the-Wash Compositions

The following compositions A–G, are solid particulate softening-through-the-wash laundry detergent compositions in accordance with the present invention. Compositions A–G have a bulk density of from 640 g/l to 850 g/l.

| Ingredient | A | B | C | D | E | F | G |
|---|---|---|---|---|---|---|---|
| Dimethyl bis (steroyl oxyethyl) ammonium chloride | 1.5% | 1% | 3% | 2% | 5% | 5% | 3% |
| Stearic acid | 1.5% | 5% | | 1% | 2% | 2.5% | 1% |
| Palmitic acid | | | 2% | | | | |
| Smectite clay | 6% | 9% | 4% | 7% | 10% | 5% | 7% |
| Polyethylene oxide flocculant | 0.2% | 0.1% | 0.2% | 0.2% | 0.1% | 0.1% | 0.2% |
| Anionic surfactant | 5% | 10% | 7% | 6% | 6.5% | 7% | 8% |
| Cationic surfactant | 2% | | 0.5% | 1.5% | 3% | 1% | 1.5% |
| Nonionic surfactant | 1% | 2% | | | | | |
| Zeolite A | 14% | 20% | 18% | 17% | 19% | 18% | 21% |
| Crystalline layered silicate | 4% | 3% | 3% | 2% | 4% | 3% | 4% |
| Anhydrous sodium carbonate | 25% | 15% | 22% | 23% | 20% | 22% | 21% |
| Anhydrous sodium sulphate | 15% | 20% | 17% | 18% | 17% | 22% | 17% |
| Acrylic/maleic copolymer | 1% | 2% | 2% | 1.5% | 1% | 1.5% | 1% |
| Sodium perborate tetrahydrate | 8% | 6% | 7% | | | | 5% |
| Sodium percarbonate | | | | 6% | 7% | 5% | |

-continued

| Ingredient | A | B | C | D | E | F | G |
|---|---|---|---|---|---|---|---|
| Tetraacetate ethylene diamine | 1% | 1.2% | 0.8% | 1% | 1.1% | 1% | 0.9% |
| Hydrophobically modified cellulose | 0.7% | 0.5% | 1% | 0.8% | | | 0.8% |
| Enzymes | 0.3% | 0.5% | 0.4% | 0.5% | 0.4% | 0.3% | 0.3% |
| Perfume | 0.2% | 0.1% | 0.2% | 0.2% | 0.1% | 0.1% | 0.3% |
| Miscellaneous | to 100 % | to 100 % | to 100 % | to 100% | to 100 % | to 100 % | to 100 % |

What is claimed is:

1. A method of softening-through-the-wash comprising the step of administering a composition to a laundry wash wherein the composition comprises:

(i) a fabric-softening cationic quaternary ammonium diester compound comprising a cationic quaternary ammonium component having the formula:

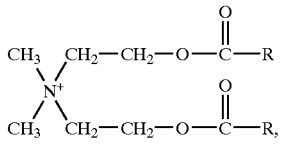

wherein, each R is independently selected from $C_{12}$–$C_{22}$ alkyl groups; and (ii) a source of acid an anionic derivative of the source of acid, or a combination thereof wherein the source of acid is selected from the group consisting of $C_{12}$–$C_{22}$ fatty acids, mono-alkyl esters of a $C_{12}$–$C_{22}$ alkyl sulphuric acids, $C_{11}$–$C_{13}$ alkyl benzene sulphonic acids, and combinations thereof;

(iii) clay; and (iv) one or more anionic surfactants wherein the anionic surfactant is $C_{8-18}$ alkyl sulfate, $C_{8-18}$ alkyl sulphonates, $C_{8-18}$ alkyl benzene sulphate, $C_{8-18}$ alkyl benzene sulphonate, $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, or combinations thereof.

2. The method according to claim 1 wherein, component (ii) is selected from $C_{12}$–$C_{22}$ fatty acids, anionic derivatives thereof, or combinations thereof.

3. The method according to claim 1 wherein the composition is a solid composition.

4. The method according to claim 1 wherein component (ii) is an anionic derivative of one or more of acids selected from the group consisting of $C_{12}$–$C_{22}$ fatty acid, mono-alkyl ester of a $C_{12}$–$C_{22}$ alkyl sulphuric acid and $C_{11}$–$C_{13}$ alkyl benzene sulphonic acid, and wherein further, component (i) and (ii) are in the form of a cationic-anionic ion-pair complex.

5. The method according to claim 1 wherein the composition is a particulate solid, and wherein further, components (i) and (ii), and optionally component (iii), are present in the same particle.

6. The method according to claim 5, wherein the particle is at least partially enclosed.

7. The method according to claim 1 wherein the clay is a smectite clay.

* * * * *